US007385461B2

(12) United States Patent
Benedikt

(10) Patent No.: US 7,385,461 B2
(45) Date of Patent: Jun. 10, 2008

(54) METHOD OF COMBINING SIGNALS AND DEVICE THEREFOR

(75) Inventor: Johannes Benedikt, Pentwyn (GB)

(73) Assignee: University College Cardiff Consultants, Ltd (GB)

( * ) Notice: Subject to any disclaimer, the term of this patent is extended or adjusted under 35 U.S.C. 154(b) by 162 days.

(21) Appl. No.: 10/514,805

(22) PCT Filed: Apr. 8, 2003

(86) PCT No.: PCT/GB03/01501

§ 371 (c)(1),
(2), (4) Date: Jul. 25, 2005

(87) PCT Pub. No.: WO03/096531

PCT Pub. Date: Nov. 20, 2003

(65) Prior Publication Data

US 2005/0275483 A1 Dec. 15, 2005

(30) Foreign Application Priority Data

May 13, 2002 (GB) ..... 0210932.0

(51) Int. Cl.
*H01P 5/12* (2006.01)
*H01P 5/18* (2006.01)

(52) U.S. Cl. ..... 333/117; 333/109

(58) Field of Classification Search ..... 333/117, 333/118, 120, 121, 122, 109
See application file for complete search history.

(56) References Cited

U.S. PATENT DOCUMENTS 1,176,924 A 3/1916 Permin (Continued)

FOREIGN PATENT DOCUMENTS

DE 28 39 874 4/1979

(Continued)

OTHER PUBLICATIONS

Search Report under Section 17, issued by the Patent Office in Great Britain, listing patents cited in application GB 0210932.0 (related application), Oct. 9, 2003, p. 1.

(Continued)

*Primary Examiner*—Dean Takaoka
(74) *Attorney, Agent, or Firm*—Jackson Walker L.L.P.; Christopher J. Rourk

(57) ABSTRACT

A bias T device (20) and a method for combining a first DC signal with a second RF signal is disclosed. The device (20) is provided with a first signal splitting means (30) in the form of a hybrid 90 degree (quadrature) coupler having at least two isolated transmission lines (34,40). The first signal splitting means (30) is adapted to receive said first signal at one input (22) and said second signal at another input (24). A second signal splitting means (32) having at least two isolated transmission lines (34', 40') is also provided. Said second signal splitting means (32) is coupled to said first signal splitting means (30) such that the respective sets of transmission lines (34, 34', 40, 40') comprise isolated signal routes (70, 72) through said device (20). An output (26) provides an output signal comprising a combination of said first DC signal and said second RF signal. A coupling effect between at least two of said transmission lines (34, 34', 40, 40') is used to combine said first signal with said second signal.

36 Claims, 8 Drawing Sheets

U.S. PATENT DOCUMENTS

| | | | | |
|---|---|---|---|---|
| 1,276,180 | A | | 8/1918 | Compton |
| 3,381,244 | A | | 4/1968 | Dailey |
| 4,240,155 | A | | 12/1980 | Vaughan |
| 4,623,921 | A | | 11/1986 | Schmitz |
| 5,155,724 | A | | 10/1992 | Edwards |
| 5,428,839 | A | * | 6/1995 | Friesen et al. ..... 455/326 |

FOREIGN PATENT DOCUMENTS

| | | | |
|---|---|---|---|
| EP | 0 066 015 | | 12/1982 |
| EP | 0 666 016 | A1 | 12/1982 |
| EP | 0 421 036 | A1 | 4/1991 |
| GB | 1 176 924 | | 1/1970 |
| GB | 1 276 180 | | 6/1972 |
| GB | 2 202 995 | | 10/1988 |
| GB | 2 380 616 | | 4/2003 |

OTHER PUBLICATIONS

Benedikt J., Tasker P.J., "High-Power Time-Domain Measurement Bench for Power Amplifier Development", 2002 ARFTG Conference Digest, Washington D.C. USA, Dec. 5-6, 2002, pp. 107-110.

url http://www.Multi-Mix.com, "Multi-Mix Pico(TM) Z Series Quad Hybrids", print-out of part of web-site of Merrimac Industries, Inc., pp. 1-5.

url http://www.emt.com/appnote1.htm, "Application Note #001 Hybrid Coupler Applications", print-out of part of web-site of EMC Technology, Inc., Apr. 2, 2002, pp. 1-3.

Anaren Microwave Components Catalog, 1984, Signal Diplexer ("Crossover") Using 3 dB 90 (degree) Hybrids, Rev. Jul. 1985, pp. 81-82, by Anaren Microwave, Inc., U.S.A.

* cited by examiner

METHOD OF COMBINING SIGNALS AND DEVICE THEREFOR

This application claims the benefit of Great Britain patent application 0210932.0, filed May 13, 2002, PCT/GB03/01501, filed Apr. 8, 2003, and is a national phase application filed under 35 U.S.C. 371(c) claiming priority to PCT/GB03/01501, all of which are hereby incorporated by reference for all purposes.

This invention relates to a method of combining signals, a device for combining signals, a method of testing the performance of an electronic device and a testing kit for testing the performance of an electronic device. The invention relates, in particular, to bias T devices suitable for broadband, high power, and high current applications.

A bias T is a type of signal combining device which can combine a first input signal with a second input signal to provide an output signal comprising a combination of the first and second inputs. In general, the first and second inputs are independent from one another and are not affected in any substantial way by connection to the bias T device or its mode of operation. This type of device may also be referred to as a Bias "Tee" device.

Owing to these properties bias T devices are useful in device characterization and testing applications. For example, bias T devices may be used to apply direct current (DC) offsets or level shifts in radio frequency (RF), pulsed radio frequency and base band testing of active devices.

FIG. 1 shows a known bias T device. The bias T device 10 comprises a first input terminal 12 for receiving a radio frequency (RF) varying signal, a second input terminal 13 for receiving a direct current (DC) signal and an output terminal 14 which comprises a combination of the radio frequency and DC signals. Within the bias T a radio frequency transmission line 15 is connected to the radio frequency input 12 and is provided with a capacitor 16. A direct current transmission line 17 connected to the direct current input 13 is provided with an inductor 18. The radio frequency and direct current transmission lines 15, 17 are connected at a node 20 located on the output side of respective components 16 and 18. The node 20 is connected to the output terminal 14.

In use, the capacitor 16 on the radio frequency transmission line 15 presents a low impedance to radio frequency signals and a high impedance to direct current. The capacitor 16 thus acts as a series blocking capacitor preventing the direct current signal from interfering with the radio frequency signal supplied to input 12. The inductor 18 on the direct current transmission line 17 presents a high impedance to radio frequency signals and a low impedance to direct current. Hence the inductor prevents the radio frequency signals which pass through the capacitor 16 from interfering with the direct current input signal supplied to input terminal 13.

The known bias T device of FIG. 1 would typically operate in direct current ranges of up to about half an amp and radio frequency ranges of up to 40 GHz. The current handling and radio frequency handling of known bias T devices is limited because such devices typically modify signal flow by virtue of transmission line geometries, for example spiral wire structures or through the effects of components connected in series with the transmission lines. A problem with such devices is that high currents and/or high radio frequency power cause heating effects which limit the range of applications of the devices. For instance, for broadband applications the inductor would need to be made from relatively thin conducting wire, thereby limiting the maximum current flow through the device.

The invention seeks to provide an improved signal combining device.

The present invention provides a bias T device for combining a first signal with a second signal, the device comprising:

first and second signal splitting circuits, each having at least two transmission lines, the signal splitting circuits together being adapted to receive a first input signal at one input and a second input signal at another input, and to provide an output signal comprising a combination of said first input signal and said second input signal, said second input signal having a frequency higher than said first input signal, wherein two transmission lines of the first signal splitting circuit are respectively electrically connected to two transmission lines of the second signal splitting circuit, and a coupling effect between at least two of the transmission lines effects, in use, the combination of said first input signal and said second input signal.

The present invention is thus able to provide a device that combines low frequency signals provided at a first input with high frequency signals provided at a second input, the device being able to operate at high powers and high frequencies whilst not suffering from the heating effect problems associated with the above described prior art device.

Each signal splitting circuit is conveniently arranged to split an input signal having a frequency within a predetermined frequency band, the signal being split between two transmission lines by virtue of said coupling effect. Each signal splitting circuit is advantageously arranged to allow an input signal below the frequency band to pass substantially without attenuation across the signal splitting circuit. Thus, whereas signals lower than the frequency band are preferably not split, signals within the band preferably are split. Signals within the frequency band may for example be transferred between transmission lines, preferably at substantially equal powers per line. The device may for example be used to combine first and second signals, whereby said first signal has a frequency that is outside the operational bandwidths of the signal splitting circuits and said second signal has a frequency that is within the operational bandwidths of said signal splitting circuits, only the second signal being split by the splitting circuits.

One of the signal splitting circuits is preferably arranged to split said second input signal into two signal components, said first and second components having a predetermined phase offset. Advantageously, one of the signal splitting circuits is arranged to split said second input signal into two signal components, said first and second components having a predetermined phase offset, and the other of the signal splitting circuits is arranged to receive said first and second signal components and to split each of said first and second signal components into at least two further signal components, said further signal components having a further predetermined phase offset. The output signal produced by the device may therefore be in the form of a combination of the first and second input signals, the component of the output signal resulting from the second input signal having a phase that is off-set from that of the second input signal. The offset of the phase of the first and second components is preferably about 90 degrees. The offset of the phase of the further signal components resulting from one of the first or second components is preferably about 90 degrees. It will be appreciated that the device could function adequately if the phase difference of the above-mentioned signals were not exactly 90 degrees. Advantageously, said further signal components interfere constructively to produce a part of the output signal, preferably substantially reproducing said second input signal.

The device is preferably arranged such that a representation of the second signal is presented at the output of the device. The output signal preferably includes a component substantially equivalent to the second signal, possibly with a phase shift, and preferably without any substantial loss. It will, however, be appreciated that the device of the invention would be of use if there were losses, especially if the losses are substantially independent of the frequency and/or power of the input signals.

The device may comprise a second output, which may for example be terminated with a predetermined electrical load. Advantageously, said at least two of said further signal components interfere constructively at said first output port and at least two of said further signal components interfere destructively at said second output port.

In certain embodiments of the present invention said transmission lines may each be in the form of electrically isolated transmission lines. For example, the electrically isolated transmission lines may form isolated signal routes through the device. In such embodiments, one of the first and second signal splitting circuits may be adapted to receive both the first and second input signals.

The two transmission lines of the first signal splitting circuit are advantageously directly electrically connected to respective lines of the two transmission lines of the second signal splitting circuit. The direct connections between the respective transmission lines preferably have substantially no effect (other than those normally associated with such transmission lines) on signals passing from the transmission line of one signal splitting circuit to the other.

In an especially preferred embodiment, there is provided a bias T device for combining a first signal with a second signal, the device comprising first and second couplers, wherein the first coupler has a first transmission line directly connected to a first transmission line of the second coupler and has a second transmission line directly connected to a second transmission line of the second coupler, the first coupler is configured to receive a first input signal at a first input connected to the first transmission line and a second input signal at a second input connected to the second transmission line, the couplers are each configured to provide a coupling effect between the first and second transmission lines of the coupler, the coupling effect affecting only those signals having a frequency within a frequency range, and the device is configured to provide an output signal at an output connected to the first transmission line of the second coupler, whereby, in use, the device is able to produce at the output a combination of a first low frequency signal, for example a DC signal, outside the frequency range with a second high frequency signal, for example an RF signal, within the frequency range, the output signal including signal components produced from the constructive interference of signals split, as a result of the coupling effect, by the couplers.

The couplers are advantageously 3dB 90° hybrid couplers, for example of the kind that are presently widely commercially available. Preferably, the device is arranged such that signals outside the frequency range travelling along one of the first and second transmission lines of a coupler do so substantially without causing a corresponding signal to travel along the other transmission line of the coupler. In such an embodiment, the low frequency signals pass along the first transmission lines of the first and second couplers without experiencing the coupling effect, whereas high frequency signals within the frequency range experience coupling effects in the first and the second couplers resulting in an output signal being presented on the first transmission line of the second coupler in response to signals inputted at the second transmission line of the first coupler. The function that the device performs on input signals may therefore be considered as including a signal filtering function as well as a signal combining function. Thus, whilst in other embodiments of the present invention where signal filters may be provided between the couplers, there is no need for such additional signal filters in this embodiment.

According to this embodiment there is also provided a method of combining two signals, the method comprising the steps of:

providing first and second couplers, the first coupler having a first transmission line directly connected to a first transmission line of the second coupler, the first coupler having a second transmission line directly connected to a second transmission line of the second coupler, the couplers each providing a coupling effect between the first and second transmission lines of the coupler, the coupling effect affecting only those signals having a frequency within a frequency range, applying a first low frequency (for example DC) signal below the frequency range to the first transmission line of the first coupler, applying a second high frequency (for example RF) signal within the frequency range to the second transmission line of the first coupler, and outputting an output signal comprising a combination of the first and second signals from the first transmission line of the second coupler, the output signal including signal components resulting from the constructive interference of signals split, as a result of the coupling effect, by the couplers.

Other features described herein with reference to the present invention may, where appropriate, be incorporated into this embodiment of the present invention.

In certain other embodiments of the present invention, at least two of said transmission lines of one of the signal splitting circuits may be electrically connected to each other. In such embodiments, the electrical connections between the respective two transmission lines of the first signal splitting circuit and the two transmission lines of the second signal splitting circuit may each include a high pass filter. In such cases, the device may be so arranged that one of the first and second signal splitting circuits is adapted to receive the first input signal and the other one of the first and second signal splitting circuits is adapted to receive the second input signal.

Respective signal paths of the device may include, or consist of, a wave guide and/or may comprise a microstrip transmission line.

In preferred embodiments of the device of the present invention, at least one, and more preferably each, of said first and second signal splitting circuits comprises a hybrid coupler. The hybrid coupler may be in the form of a 90° hybrid coupler, for example a quadrature hybrid coupler.

The present invention also provides a method of combining signals having different fundamental frequencies, the method comprising the steps of:

providing two signal splitting circuits electrically connected to each other, the circuits together having two inputs and at least one output, each signal splitting circuit comprising at least two transmission lines, the signal splitting circuits splitting input signals within a frequency band between two transmission lines by virtue of a coupling effect between the lines, applying a first input signal to one of the two inputs, applying a second input signal having a fundamental frequency within the frequency band to the other of the two inputs, the second input signal having a fundamental frequency higher than that of the first input signal and outputting an output signal from said at least one output, the output signal comprising a combination of the first and second input signals, the combination being effected by the coupling effect of each of the two signal splitting circuits.

The method is of particular application where the first input signal has a fundamental frequency lower than the frequency band, and especially where the first input signal has a DC component. The first input signal may for example be a DC signal, with little or no higher order components. The second input signal may for example be a high frequency signal or an RF signal.

The method advantageously includes a step of splitting the second input signal into first and second signal components. In certain embodiments of the present invention both of the first and second input signals may be split by the signal splitting circuits. The step of splitting the second input signal into first and second signal components advantageously includes imparting a relative phase shift such that said first and second signal components have a predetermined phase offset, which is preferably substantially 90 degrees. The method preferably includes a further step of splitting each of said first and second signal components into at least two further signal components and imparting a further relative phase shift, such that said further signal components have a predetermined phase offset with respect to one another, which again is preferably substantially 90 degrees. Said second input signal is advantageously substantially reproduced by constructive interference effects between said further signal components.

The reproduction of the second input signal is preferably in the form of a signal comprising a combination of the first input signal and the reproduction (possibly phase shifted) of the second input signal, the resulting signal being receivable as an output signal. The method is advantageously able to produce an output signal comprising a summation of the input signals substantially without loss.

Each transmission line of the two signal splitting circuits preferably allows signals lower than the frequency band to pass substantially without attenuation.

In certain embodiments high pass filtering may be applied to at least one of the signals between said first and second signal splitting circuits, said second input signal being substantially unaffected by the high pass filtering.

The method of the present invention may conveniently be performed using first and second signal splitting circuits arranged in accordance with the bias T device according to the present invention.

The present invention also provides a method of testing the performance of an electronic device, the method including a step of applying a high power electronic signal comprising a low frequency component and a high frequency component by means of the use of a bias T device according to the present invention or by means of a method of combining signals according to the present invention. The method of testing may be performed such that the low frequency component includes or consists of a DC signal and/or such that the high frequency component includes or consists of a signal having a fundamental frequency of greater than 500 MHz.

In the context of the present invention it will be understood that a signal having a power greater than 10 Watts may be considered as being high power. The device and method of the present invention may be able to handle signals at powers significantly greater than 10 Watts, for example, at powers greater than 50 Watts. Unless it is clear from the context that another meaning is intended, signals having a fundamental frequency greater than 500 MHz may be considered as being high frequency signals and signals substantially lower than 500 MHz may be considered as being low frequency signals.

The present invention yet further provides a testing kit including a bias T device according to the present invention, a low frequency power source and a high frequency power source. The testing kit is advantageously suitable for performing the method of testing the performance of an electronic device according to the present invention. For example, the low frequency power source may be connected to a first input of a bias T device of the present invention to provide the low frequency component and the high frequency power source may be connected to a second input of the bias T device to provide the high frequency component, the output of the bias T device providing the high power electronic signal for testing the performance of a given electronic device.

The testing method and kit of the present invention may be of particular application in relation to the analysis, development, design and improvement of high frequency, high power devices, for example, transistor devices or other components used in amplification and/or signal processing circuits used in high power broad band applications. Such applications may for example include amplification circuits used in mobile telecommunication base stations.

Reference is made herein to a device and a method for effecting a combination of a first signal having a first frequency and a second signal having a second higher frequency. The present invention is of particular application when the first signal is a DC signal and the second signal is an RF signal. It will however be appreciated that the present invention may also be of benefit in applications where first and second signals are combined, wherein the first signal is outside an operational frequency band and the second signal is within the operational frequency band. For example, there may, according to a further aspect of the present invention, be provided a device for combining a first signal outside a frequency range with a second signal within the frequency range, the device comprising first and second signal splitting circuits, each having at least two transmission lines, the signal splitting circuits together being adapted to receive a first input signal at one input and a second input signal at another input, and to provide an output signal comprising a combination of said first input signal and said second input signal, wherein two transmission lines of the first signal splitting circuit are respectively electrically connected to two transmission lines of the second signal splitting circuit, and a coupling effect between at least two of the transmission lines effects, in use, the splitting of signals within the frequency range and the combination of said first input signal and said second input signal. A corresponding method may also be provided, such a method comprising the steps of providing two signal splitting circuits electrically connected to each other, the circuits together having two inputs and at least one output, each signal splitting circuit comprising at least two transmission lines, the signal splitting circuits splitting input signals within a frequency range between two transmission lines by virtue of a coupling effect between the lines, applying a first input signal having a fundamental frequency outside the frequency range to one of the two inputs, applying a second input signal having a fundamental frequency within the frequency range to the other of the two inputs, and outputting an output signal from said at least one output, the output signal comprising a combination of the first and second input signals, the combination being effected by the coupling effect of each of the two signal splitting circuits. Thus, in this context, the first input signal may be at a frequency higher than the second input signal. Other features described herein with reference to the resent invention may, where appropriate, be incorporated into his particular aspect of the present invention.

Embodiments of the present invention will now be described, by way of example only, with reference to the accompanying drawings in which.

Figure 1:
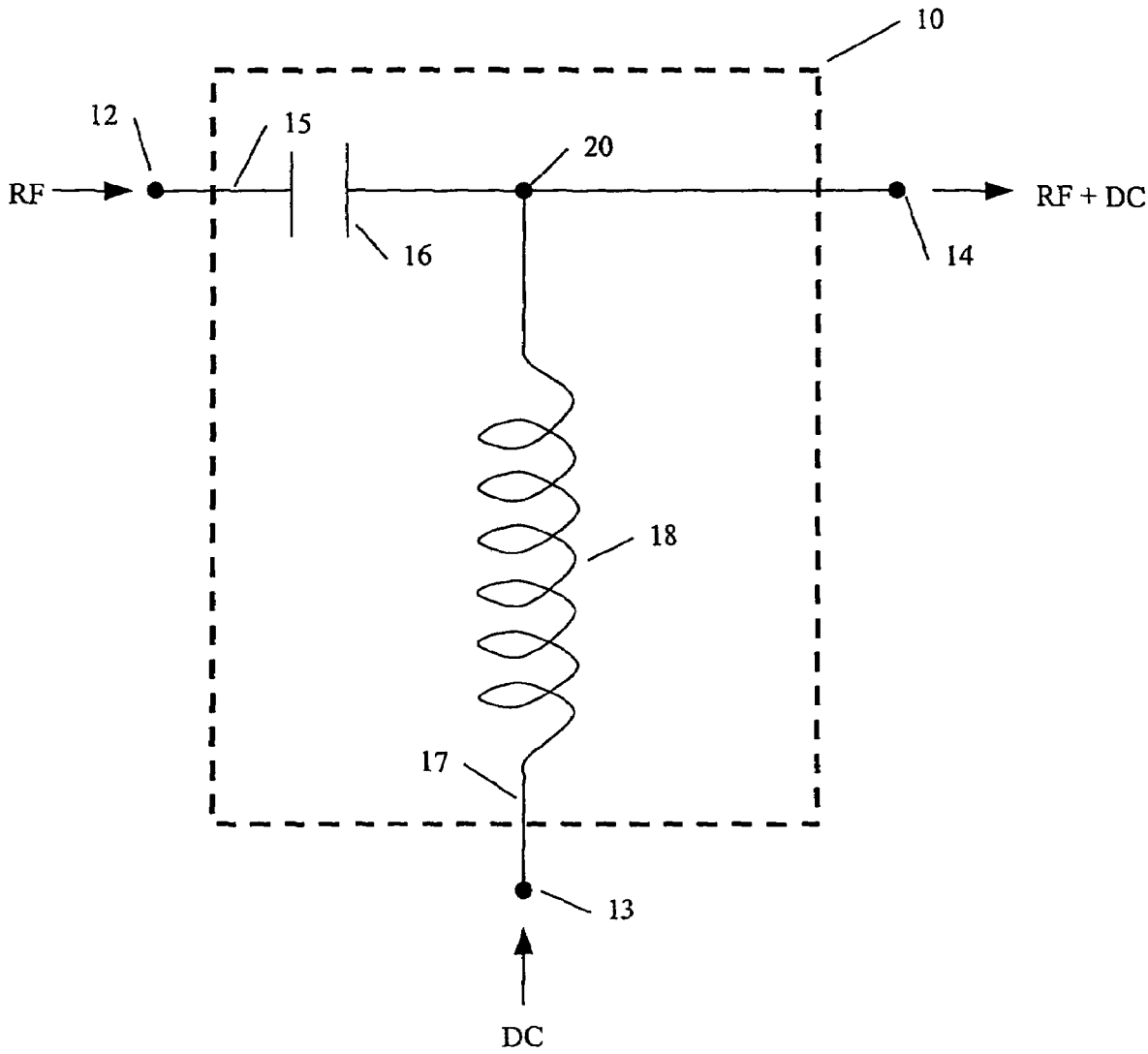
FIG. 1 illustrates a known bias T device.
Figure 2:
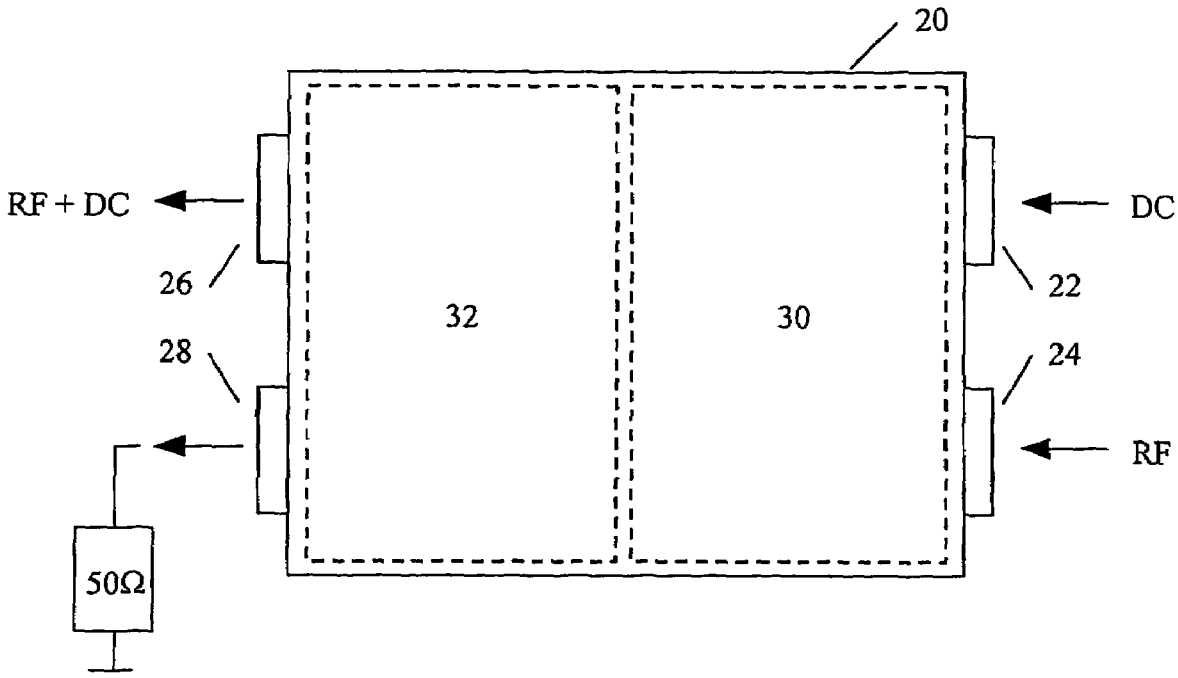
FIG. 2 illustrates a high current bias T device embodying the present invention.
Figure 3A:
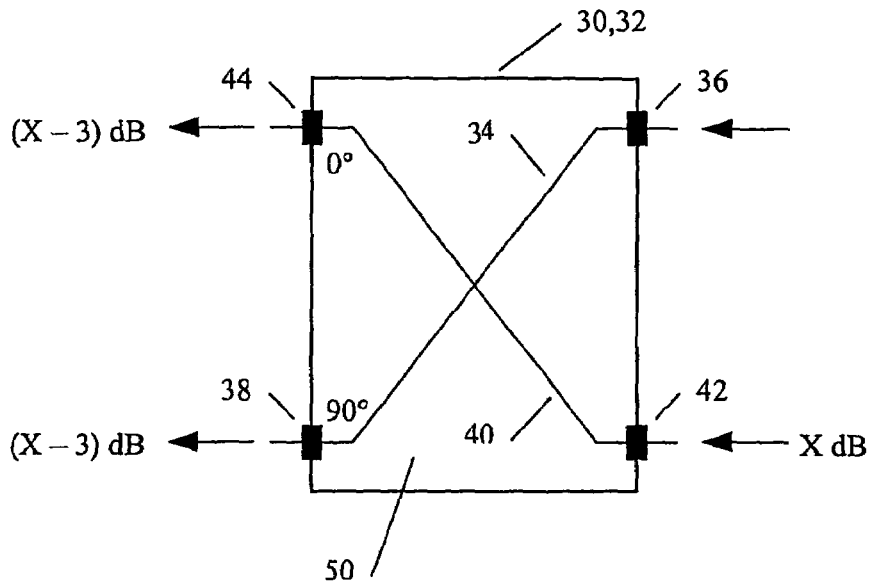
Figure 3B:
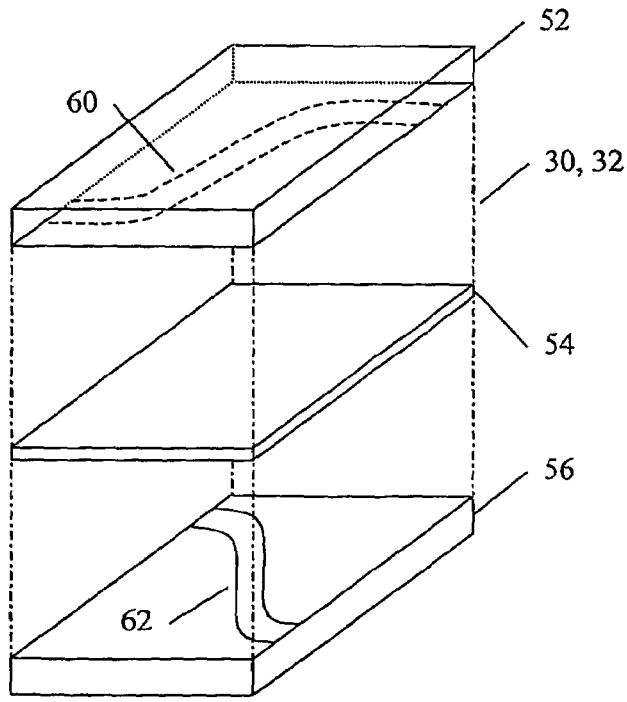
Figure 4:
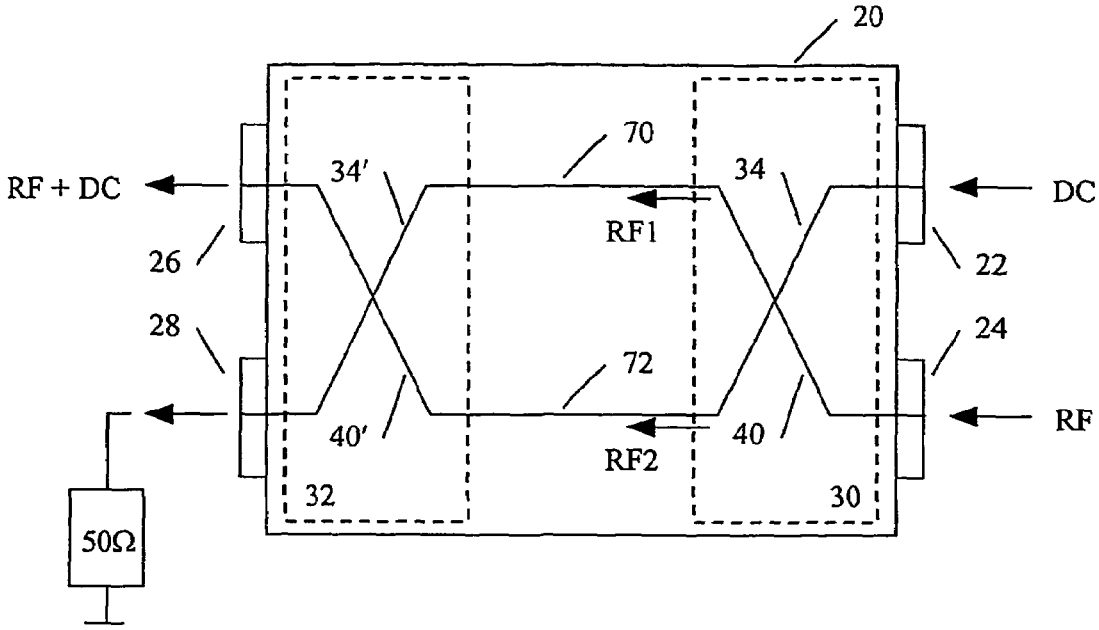
Figure 5:
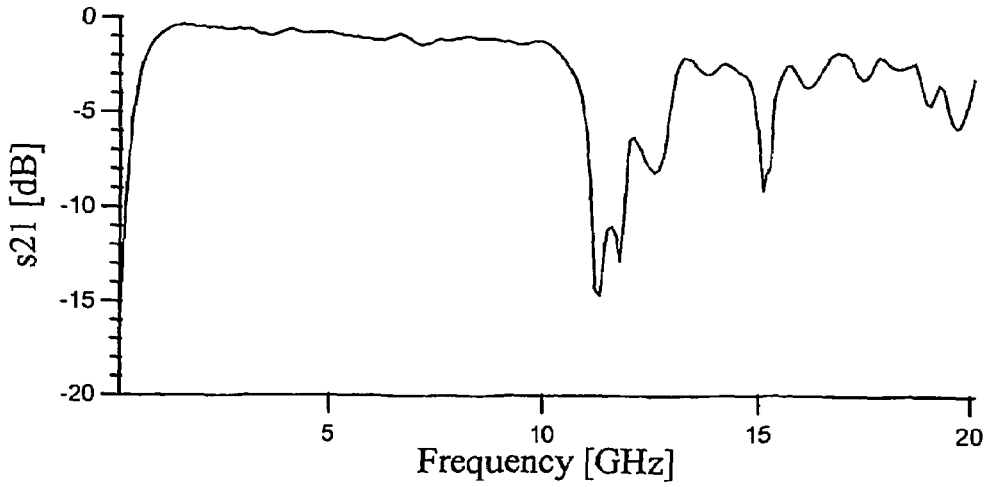
Figure 6:
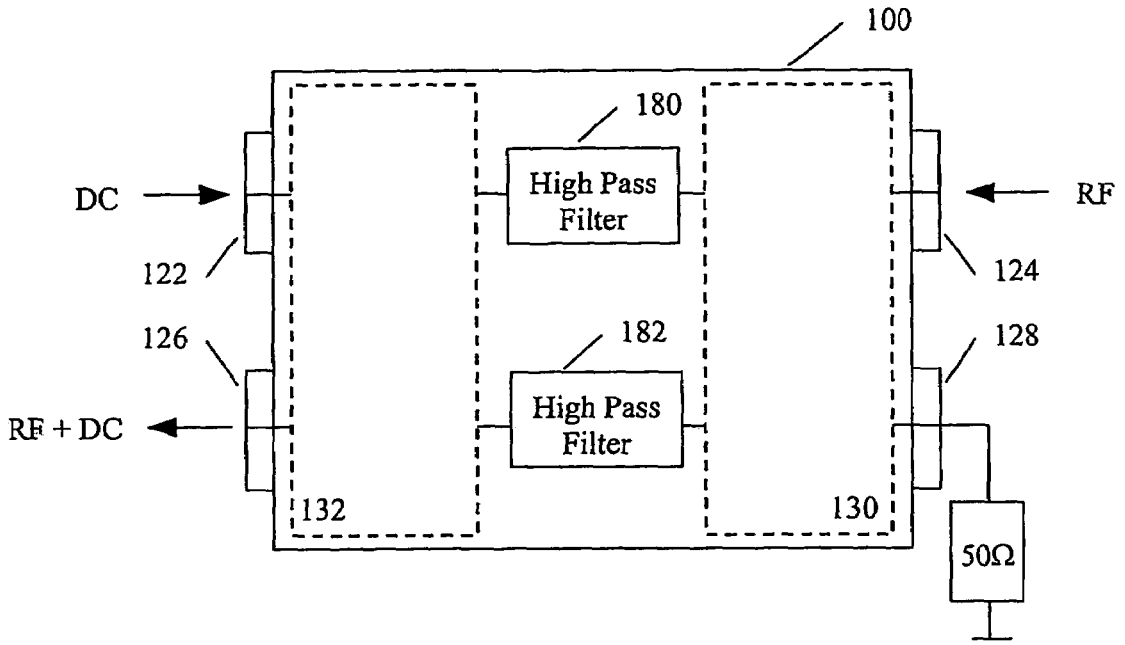
Figure 7A:
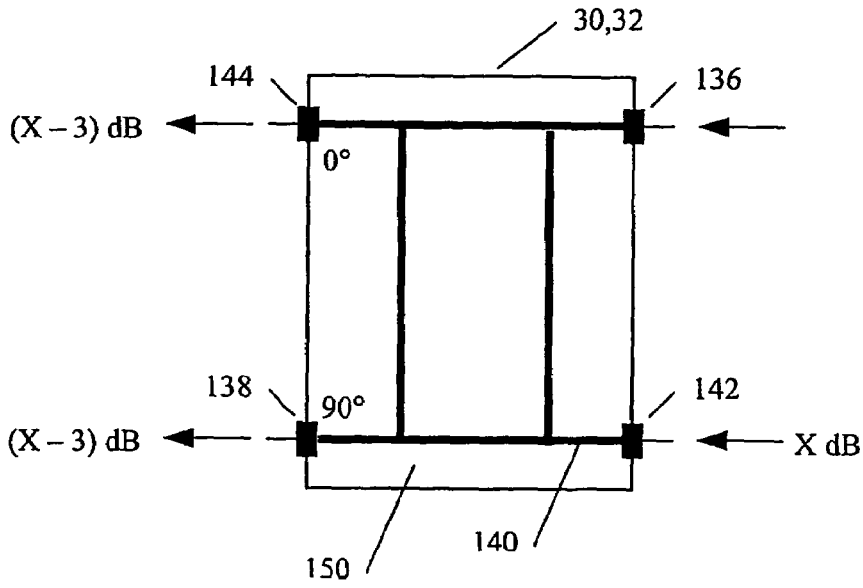
Figure 7B:
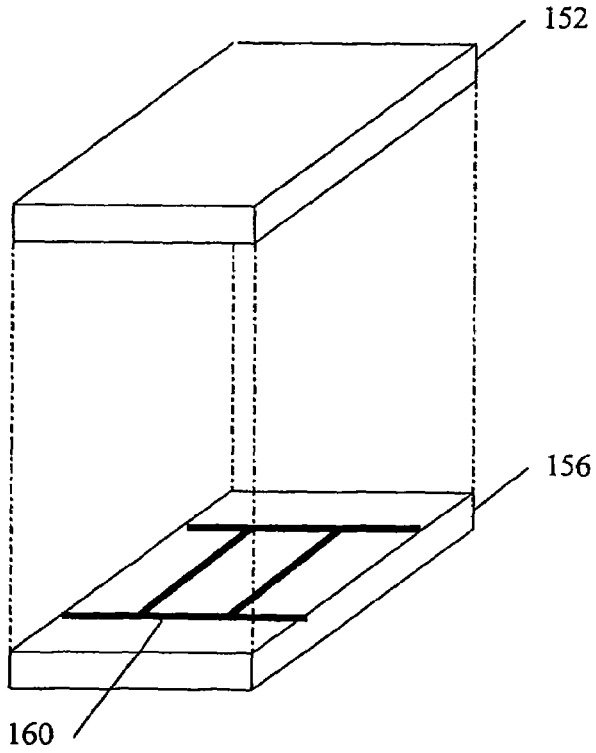
Figure 8:
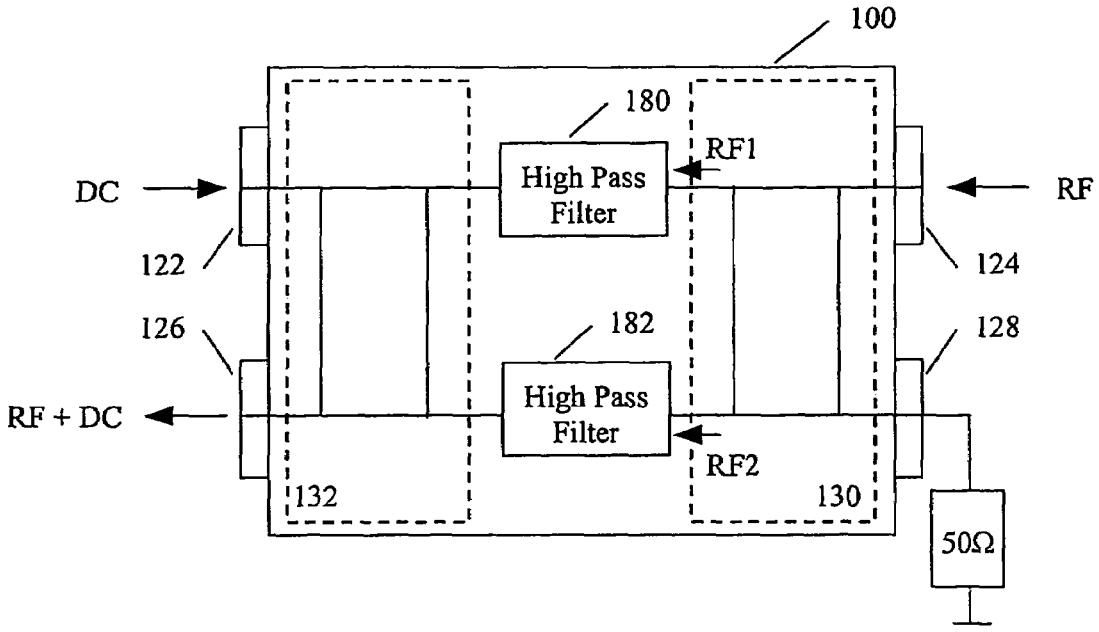
Figure 9:
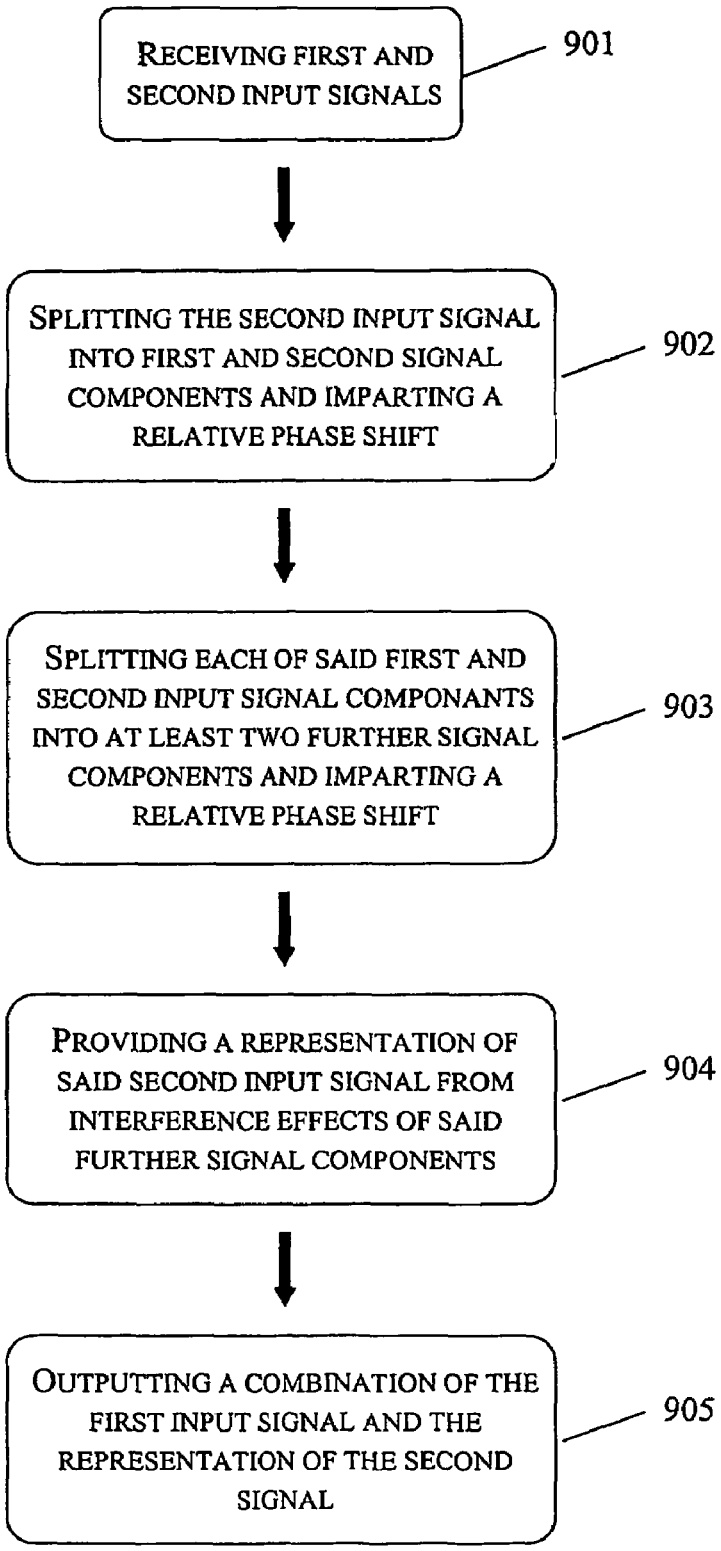

FIG. 3*a* is a schematic plan view of a 90° hybrid circuit such as those used in the embodiment of FIG. 2;

FIG. 3*b* is an exploded perspective view of a 90° hybrid circuit;

FIG. 4 illustrates the embodiment of FIG. 2 with signal routes illustrated schematically;

FIG. 5 illustrates S-parameter transmission results for the embodiment of FIG. 2;

FIG. 6 illustrates another high current bias T device embodying the present invention;

FIG. 7*a* is a schematic plan view of a 90° hybrid circuit such as those used in the embodiment of FIG. 6, FIG. 7*b* illustrates an exploded perspective view of the 90° hybrid circuit;

FIG. 8 illustrates the embodiment of FIG. 6 with signal routes illustrated schematically; and FIG. 9 is a flow chart illustrating a mode of operation of bias T devices embodying the present invention.

FIG. 2 shows a high current bias T device 20 implemented using two back-to-back hybrid circuits. The bias T has a first input port 22 adapted to receive a direct current signal and a second input port 24 adapted to receive a radio frequency signal. The bias T device 20 has two further ports, the first of which 26 provides an output signal combining the signals at the input ports 22 and 24 and the second of which 28 is terminated by a 50Ω load. This 50Ω load is optional and is connected to the bias T in order to counter some imperfections of the hybrids as will be explained hereinafter. The bias T device 20 comprises a first 90° hybrid circuit 30 coupled to a second 90° hybrid circuit 32. The input ports 22 and 24 are provided on the first 90° hybrid circuit 30 and the output ports 26 and 28 are provided on the second 90° hybrid circuit 32.

The bias T device of FIG. 2 is used here to combine a radio frequency signal supplied at port 24 with a direct current signal supplied at port 22 to provide an output signal at port 26 comprising direct current and radio frequency components without either of the signals at ports 22 and 24 being perturbed in any way.

FIG. 3*a* and 3*b* illustrate a 90° hybrid circuit of the type used to implement the bias T device of FIG. 2. The schematic plan view of FIG. 3*a* shows a transmission line 34 connecting a first input port 36 to a diagonally opposed output port 38. A second transmission line 40 connects a second input port 42 to a second diagonally opposed output port 44. The transmission lines 34,40 may be of any convenient type, for example they may be wave guides or microstrip lines. In this embodiment, the transmission lines are disposed within a block of dielectric material 50.

With reference to FIG. 3*b*, the dielectric block 50 is comprised of an upper substrate 52, a thin isolation layer 54 and a lower substrate 56. A first metalised region 60 disposed on a lower surface of the upper substrate layer 52 defines the transmission line 34. A second metalised region 62 disposed on an upper surface of the lower substrate layer 56 defines the transmission line 40. The transmission lines 34,40 follow diagonal paths on opposed faces of the respective substrate layers 52,56. The isolation layer 54 disposed between the transmission lines 34,40 electrically isolates the transmission lines from each other. The inputs 36 and 42 are also electrically isolated from one another.

The two transmission lines of each hybrid circuit are arranged in such a way that a coupling occurs between the lines for signals within the operational bandwidth of the 90° hybrid. For signals having frequencies outside the operational bandwidth of the hybrid circuits no coupling occurs (e.g. a DC signal) and isolation between the transmission lines is effective to prevent signals on different lines from mixing.

Each 90° hybrid circuit 30,32 acts as a three decibel coupler with a transmission line 34 connected between ports 36 and 38 and a second transmission line 40 between ports 42 and 44. In one envisaged use, a direct current provided at the input port 36 will be supplied directly to the output port 38 without any current leaking onto the transmission line 40. However, the hybrid circuit would split a radio frequency signal having a frequency within the operational bandwidth into two separate radio frequency output signals. An input signal of X decibels would be split into two equal amplitude output signals at ports 44 and 38 and each having a power of X-3 decibels. A signal diagonally traversing a 90° hybrid circuit experiences a 90° phase shift relative to a signal following a straight through signal path. Thus the radio frequency output signals at ports 44 and 38 are of equal amplitude and have a relative phase offset of 90°. The above assumptions neglect line losses and imperfections in the hybrid circuit.

FIG. 4 shows the bias T device 20 of FIG. 2 with signal routes through the device illustrated schematically. The two 90° hybrid circuits are coupled together such that the transmission line 34 of the first hybrid circuit 30 connects to the transmission line 40' of the second hybrid circuit 32. This forms a continuous signal path 72 between ports 22 and 26 of the device. The transmission line 40 of the first hybrid circuit 30 connects to transmission line 34' of the second hybrid circuit 32 forming a continuous signal path 70 between ports 24 and 28 of the device. The continuous paths are electrically isolated from one another by the isolation layers 54 in respective hybrid circuits 30,32. Signals within the operational bandwidth of the 90° hybrids experience a coupling effect and are transferred between the two transmission paths. Signals outside this operational bandwidth (e.g. a DC signal) do not couple and so cannot overcome the isolation between the transmission paths to transfer from one to the other.

The direct current input at the port 22 of the first hybrid circuit 30 travels along the signal path 72 through the first hybrid circuit 30 and into the second hybrid circuit 32. The DC current signal is output at port 26 without any DC signal components affecting the signal on the signal path 70 or at either of the ports 24 and 28.

A radio frequency signal which is input at port 24 does not follow a single path. The radio frequency signal is split into two separate signals as it passes through the first hybrid circuit 30. The splitting of the radio frequency is caused by a coupling between the transmission line 40 connected to port 24 and the transmission line 34 which is also used for the DC signal. The first $RF_1$ and second $RF_2$ radio frequency signals resulting from the coupling effect have a phase difference of 90°. The signals $RF_1$ and $RF_2$ are output from the first hybrid circuit 30 and supplied to the respective input ports of the second hybrid circuit 32. A coupling effect between transmission lines 34' and 40' of the second hybrid circuit 32 means that the radio frequency signal $RF_1$ received at the input connected to line 34' is partially coupled onto the transmission line 40'. At the same time the radio frequency signal $RF_2$ received at the input connected to line 40' is partially coupled onto transmission line 34'.

Each of the signals $RF_1$ and $RF_2$ is split into two further signal components as they traverse the second hybrid circuit 32. Between these signal components an additional phase shift is imparted. As a result, the signal components interfere constructively at the output port 26. The signals interfere destructively at the output port 28 such that they can cancel each other out.

If the phase offset within a hybrid is not exactly 90° C. the signals at port 28 will not be exactly combined out-of-phase and hence they will not cancel each other out completely. The 50Ω load absorbs the remaining signal preventing them from interfering with signals at port 26.

The result is that the radio frequency signal input at the port 24 appears without loss at the output port 26 where it is combined with the direct current signal supplied to the other input port 22. The line losses and losses caused by imperfections are neglected within this specific description since they are small within the realized device. However, within other embodiments (e.g. using hybrids with larger imperfections) they may not be neglected.

The above described embodiment thus uses a coupling effect between separate transmission lines in 90° hybrid circuits to combine a radio frequency signal with a DC signal. The coupling effect depends mainly on the distance between the two transmission lines and does not depend substantially on the width of the transmission lines. Accordingly, the above embodiment overcomes problems with the prior art in that thick transmission lines can be used in preferred embodiments. Therefore preferred embodiments need not be limited to low current ranges, low power high frequency signals, or narrow radio frequency operating bandwidths. Therefore, no trade-off is necessary between high DC current handling capability and broad bandwidth of the signal-combining device.

FIG. 5 shows transmission S-parameter results obtained using a bias T device according to FIG. 2. The hybrid circuits used were rated to pass signals at frequencies in the range of 1.3 to 10 GHz. A skilled person will appreciate that these S-parameter results were obtained by connecting a suitable frequency generator to the input port 24 and measuring the response at the output port 26 of the bias T device 20. Referring to FIG. 5, the bias T operates reliably in the bandwidth range 1.3 to 10 GHz. Satisfactory results have been obtained using DC input currents of 10 or more amps.

The embodiment described with reference to FIGS. 2 to 4 uses a DC signal at port 22. However, the device is suitable to combine any signals of which one is outside and the other within the operational bandwidth of the hybrids. That is, the above-described device would combine any signals input at port 22, which may be outside the operational bandwidth of the hybrid circuitry, with any signals input at port 24, which are within the operational bandwidth of the hybrid circuitry. The device in FIGS. 2 and 4 splits only the signal inserted at port 24 into multiple frequency components with a phase offset. As a result, the device may not require filters or other selective signal blocking means between the two hybrids. That is, the principle of operation relies on only one input signal component being split into multiple signals while the second signal is directly forwarded from one port to another without being split.

Preferred embodiments such as the one illustrated in FIG. 2 can therefore be used to combine two radio frequency signals. For example, this can be achieved by inputting a first radio frequency signal (having a frequency outside the operational bandwidth of the hybrid circuits) to input port 22 and inputting a second radio frequency signal (having a frequency within the operational bandwidth of the hybrid circuits) to input port 24. The signal output at port 26 is then a combination of the first and second RF signals input at ports 22 and 24.

Using different hybrid circuits with larger frequency operating ranges it is possible to provide bias T devices with different operating ranges. For example, other hybrid circuits have operating frequencies in the range 1 to 18 GHz or more and so can extend the operating bandwidth of preferred bias T devices up to 18 GHz. Other hybrid circuits can extend the operating bandwidth still further. Appropriately designed transmission lines will permit still higher operating currents. Preferred embodiments thus provide bias T devices which are operable at high currents, high frequencies with high power levels, and over large bandwidth ranges. Such bias T devices are useful for example in the testing of high powered transistors. However, preferred embodiments can also be used in many other applications, such as in amplification applications.

FIG. 6 shows another bias T device embodying the present invention. The transmission lines (and inputs) of the hybrid circuits employed in this embodiment are not electrically isolated from one another. The bias T device comprises a first input port 122 for receiving a direct current signal and a second input port 124 for receiving a radio frequency signal. The bias T device 100 has two further ports, the first of which 126 provides an output signal which is a combination of the radio frequency and direct current signals at input ports 124 and 122. The second further port is an output port 128 terminated by an optional 50 electrical load. The bias T device 100 comprises a first 90° hybrid circuit 130 and a second 90° hybrid circuit 132.

In this embodiment, the radio frequency input port 124 is provided on the first hybrid circuit 130 and the direct current input port 122 is provided on the second hybrid circuit 132. High pass filters 180 and 182 are disposed between the first and second hybrid circuits 130,132, one on each of the signal paths as will be explained herein. The bias T device 100 of FIG. 6 can combine a radio frequency signal supplied to the port 124 with a direct current signal supplied to the port 122 in order to provide an output signal comprising both radio frequency and direct current components without affecting either of the input signals in any way.

FIGS. 7*a* and 7*b* illustrate a hybrid circuit of the type described to implement the bias T device 100 of FIG. 6. The transmission lines are arranged to form a quadrilateral shape 134 with spurs 140 connecting to each of the input and output ports. The transmission lines 134,140 are formed by a metalised region disposed between dielectric layers 152, 156. Since there is no isolation between any of the respective transmission lines (or the input and output terminals) the metalised region 160 of the 90° hybrid circuit may be regarded as a continuous transmission line system. Hybrid circuits of the type shown in FIGS. 7*a* and 7*b* can split a radio frequency signal input at port 136 into two radio frequency signals of substantially the same amplitude which are output at ports 144 and 138. The radio frequency signals output at ports 144 and 138 have a relative phase difference of 90° which is imparted to them by the hybrid circuit.

FIG. 8 shows the bias T device 100 of FIG. 6 with signal paths through the device illustrated schematically. The two 90° hybrid circuits 130,132 are arranged as in a branch line coupler with two high pass filters 180,182 coupling them together. The high pass filters 180,182 are tuned so as to prevent the direct current passing while allowing the radio frequency signal to pass. The direct current signal input at port 122 of the second hybrid circuit 132 is blocked by the high pass filters 180,182. The direct current signal is output at port 126 of the second hybrid circuit 132 without passing into the first hybrid circuit 130.

The radio frequency signal input at port 124 of the first hybrid circuit 130 is split into two separate signals $RF_1$ and $RF_2$ as it traverses the first hybrid circuit 130. The second radio frequency signals $RF_1$ and $RF_2$ output from the first hybrid circuit 130 have a relative phase offset of 90°. The radio frequency signals $RF_1$ and $RF_2$ pass through the respective high pass filters 180,182 and are input to the respective input ports of the second hybrid circuit 132. The radio frequency signals $RF_1$ and $RF_2$ are split into further radio frequency components while they traverse the second hybrid circuit 132. The output signals derived from radio frequency signal $RF_1$ have a 90° relative phase offset after they have traversed the hybrid circuit 132. The output signals derived from radio frequency signal $RF_2$ have a similar 90° phase offset after they have passed through the hybrid circuit 132. Accordingly, the signals derived from the signals $RF_1$ and $RF_2$ interfere constructively at the output port 126 and destructively at the output port 128. The result is that the radio frequency signal input at port 124 appears substantially without loss at the port 126 where it combines with the direct current signal also supplied to that port from port 122.

In the example described with reference to FIGS. 6 to 8, a device is used to combine a radio frequency signal input at port 124 with a direct current signal input at port 122. The signal input at port 122 need not be a direct current signal. For example, the signal input at port 122 may be an alternating signal having a frequency anywhere in the range between zero and the cut-off frequency of the high pass filters 180,182. In practice, the high pass filter can be selected to have a lower cut-off frequency between the frequencies of the signal input at port 124 and the signal input at port 122. In this way, the device of FIGS. 6 to 8 can be used to combine a first alternating signal input at point 124 with a second signal having a frequency anywhere between zero up to the cut-off frequency. It will be apparent that the signal input at port 122 can be inside or outside the operational bandwidth of the hybrid 132.

Both embodiments described herein use hybrid circuits to re-combine components of at least one of the input signals.

Reference is now made to FIG. 9 illustrating the operation in accordance with an embodiment.

At step 901, a combining device receives first and second input signals. In the examples described herein the first input signal is a direct current signal and the second input signal is a radio frequency signal.

At step 902, a first signal splitting means is supplied with the second input signal which it splits into first and second signal components. The first signal splitting means also imparts a relative phase shift to signals which pass through it such that the first and second signal components have a predetermined phase offset.

At step 903, a second signal splitting means is arranged to split each of the first and second signal components into at least two further signal components. The second signal splitting means also imparts a further relative phase shift to signals which pass through it such that the further signal components have a further predetermined phase offset.

At step 904, a representation of the second input signal is provided at an output where interference effects between the further signal components arise.

Finally, at step 905 the device outputs a combination of the first input signal and the representation of the second input. Owing to the nature of the interference effects which lead to the representation of the second input signal the signals are combined at the output substantially without any losses.

The above describes the operation in accordance with FIGS. 2 to 5 in which only one of the signals is split. In the embodiment as described with reference to FIGS. 6 to 8 both of the incoming signals are split. In the latter embodiment the signal inserted at port 122 does not necessarily have to be outside the operational bandwidth of the hybrid circuit 132. If the signal is outside the operational bandwidth the signal splitting does not take place and this signal is simply output at port 126 while the other signal is processed as described above. If the signal is inside the operational bandwidth the signal inserted at port 122 is split into two components with a 90° offset. These components are output at the filters 180 and 182. These two filters are preferably selected such that they reflect the signal inserted at port 122. These signal components are then re-reflected into the hybrid 132 and each signal component is split into two further components with a 90° offset. The created signals combine constructively at port 126 and destructively at port 122.

It will be apparent that the embodiment of FIGS. 6 to 8 affords similar advantages to the embodiment of FIGS. 2 to 4.

Implementations of the invention should not be limited to the configurations of the described embodiments. Specifically, the described embodiments are examples of configurations which may be used to implement preferred methods and are not intended to define the only apparatus features/method steps which can be used.

The invention claimed is:

1. A bias T device for combining a first signal with a second signal, the device comprising:

first and second signal splitting circuits, each having at least two transmission lines, the signal splitting circuits together being adapted to receive a first input signal at one input and a second input signal at another input, and to provide an output signal comprising a combination of said first input signal and said second input signal, said second input signal having a frequency higher than said first input signal, wherein two transmission lines of the first signal splitting circuit are respectively electrically connected to two transmission lines of the second signal splitting circuit, and a coupling effect between at least two of the transmission lines effects, in use, the combination of said first input signal and said second input signal, and wherein the two transmission lines of the first signal splitting circuit are directly electrically connected to respective lines of the two transmission lines of the second signal splitting circuit.

2. A device according to claim 1, wherein at least one of said first and second signal splitting circuits comprises a 90° hybrid coupler.

3. A device according to claim 1, wherein the device is so arranged and configured as to be suitable for combining a first signal with a second signal, wherein the first signal has a DC component.

4. A device according to claim 1, wherein the device is so arranged and configured as to be suitable for combining a first signal with a second signal, wherein the second signal includes or consists of a signal having a fundamental frequency of greater than 500 MHz.

5. A device according to claim 1, wherein one of the first and second signal splitting circuits is adapted to receive both the first and second input signals.

6. A device according to claim 1, wherein each signal splitting circuit is arranged to split an input signal within a frequency band between two transmission lines by virtue of said coupling effect and to allow an input signal below the frequency band to pass substantially without attenuation across the signal splitting circuit.

7. A device according to claim 1, wherein one of the signal splitting circuits is arranged to split said second input signal into two signal components, said first and second components having a predetermined phase offset, and the other of the signal splitting circuits is arranged to receive said first and second signal components and to split each of said first and second signal components into at least two further signal components, said further signal components having a further predetermined phase offset.

8. A device according claim 7, wherein said further signal components interfere constructively to reproduce substantially said second input signal.

9. A device according to claim 1 comprising a second output, which is terminated with a predetermined electrical load.

10. A device according to claim 9, wherein one of the signal splitting circuits is arranged to split said second input signal into two signal components, said first and second components having a predetermined phase offset, and the other of the signal splitting circuits is arranged to receive said first and second signal components and to split each of said first and second signal components into at least two further signal components, said further signal components having a further predetermined phase offset, and at least two of said further signal components interfere constructively at said first output port and at least two of said further signal components interfere destructively at said second output port.

11. A device according to claim 1, wherein said transmission lines are each electrically isolated transmission lines, which form isolated signal routes through the device.

12. A method of combining signals having different fundamental frequencies, the method comprising the steps of:

providing two hybrid couplers each comprising at least two transmission lines, the couplers being directly electrically connected to each other, so that signals passing from one coupler to the other coupler along either transmission line are substantially unaffected, the couplers together having two inputs and at least one output, the couplers splitting input signals within a frequency band between two transmission lines by virtue of a coupling effect between the lines, applying a first signal to one of the two inputs, applying a second signal having a fundamental frequency within the frequency band to the other of the two inputs, the second signal having a fundamental frequency higher than that of the first signal and outputting an output signal from said at least one output, the output signal comprising a combination of the first and second signals, the combination being effected by the coupling effect of each of the two couplers.

13. A method according to claim 12, wherein one of the first and second couplers receives both the first and second input signals.

14. A bias T device for combining a first signal with a second signal, the device comprising:

first and second hybrid couplers, each having at least two transmission lines, the couplers together being adapted to receive a first input signal at one input and a second input signal at another input, and to provide an output signal comprising a combination of said first input signal and said second input signal, said second input signal having a frequency higher than said first input signal, wherein two transmission lines of the first coupler are directly electrically connected to two respective lines of the second coupler so that signals passing from one of said first and second hybrid couplers to the other of said first and second hybrid couplers along either transmission line are substantially unaffected, and a coupling effect between at least two of the transmission lines effects, in use, the combination of said first input signal and said second input signal.

15. A device according to claim 14, wherein one of the first and second couplers is adapted to receive both the first and second input signals.

16. A device according to claim 14, wherein one of the first and second couplers is adapted to receive both the first and second input signals.

17. A method of combining signals having different fundamental frequencies, the method comprising the steps of:

providing two signal splitting circuits electrically connected to each other, the circuits together having two inputs and at least one output, each signal splitting circuit comprising at least two transmission lines, the signal splitting circuits splitting input signals within a frequency band between two transmission lines by virtue of a coupling effect between the lines, applying a first signal to one of the two inputs, applying a second signal having a fundamental frequency within the frequency band to the other of the two inputs, the second signal having a fundamental frequency higher than that of the first signal and outputting an output signal from said at least one output, the output signal comprising a combination of the first and second signals, the combination being effected by the coupling effect of each of the two signal splitting circuits, wherein the two transmission lines of the first signal splitting circuit are directly electrically connected to respective lines of the two transmission lines of the second signal splitting circuit.

18. A method according to claim 17, wherein each transmission line of the two signal splitting circuits allows signals lower than the frequency band to pass substantially without attenuation.

19. A method according to claim 17, wherein the first signal has a fundamental frequency lower than the frequency band.

20. A method according to claim 17, wherein the first signal has a DC component.

21. A method according to claim 17, wherein the second signal includes or consists of a signal having a fundamental frequency of greater than 500 MHz.

22. A method according to claim 17, the method including a step of splitting the second input signal into first and second signal components and imparting a relative phase shift such that said first and second signal components have a predetermined phase offset.

23. A method according to claim 22, wherein the method includes a further step of splitting each of said first and second signal components into at least two further signal components and imparting a further relative phase shift, such that said further signal components have a predetermined phase offset with respect to one another.

24. A method as claimed in claim 23, wherein said second input signal is substantially reproduced by constructive interference effects between said further signal components.

25. A testing kit for performing a method of testing the performance of an electronic device, the method including a step of applying an electronic signal having a power greater than 10 Watts, the signal comprising a low frequency component and a high frequency component, the testing kit including a low frequency power source for generating the low frequency component, a high frequency power source for generating the high frequency component, and a bias T device for combining the low and high frequency components, the bias T device comprising:

first and second signal splitting circuits, each having at least two transmission lines, the signal splitting circuits together being adapted to receive a first input signal at one input from the low frequency power source and a second input signal at another input from the high frequency power source, and to provide an output signal comprising a combination of said first input signal and said second input signal, wherein two transmission lines of the first signal splitting circuit are respectively electrically connected to two transmission lines of the second signal splitting circuit, and a coupling effect between at least two of the transmission lines effects, in use, the combination of said first input signal and said second input signal.

26. A method of combining a first signal having a DC component with a second signal including or consisting of a signal having a fundamental frequency of greater than 500 MHz, the method comprising the steps of:

providing two hybrid couplers electrically connected to each other, the couplers together having two inputs and at least one output, each coupler comprising at least two transmission lines, the couplers splitting input signals within a frequency band between two transmission lines by virtue of a coupling effect between the lines, applying a first signal to one of the two inputs, applying a second signal having a fundamental frequency within the frequency band to the other of the two inputs, and outputting an output signal from said at least one output, the output signal comprising a combination of the first and second signals, the combination being effected by the coupling effect of each of the two couplers.

27. A method according to claim 26, wherein one of the first and second couplers receives both the first and second input signals.

28. A method of testing the performance of an electronic device, the method including a step of applying an electronic signal having a power greater than 10 Watts, the signal comprising a low frequency component and a high frequency component, the method including producing the electronic signal by combining a signal comprising the low frequency component with a signal comprising the high frequency component by means of performing the following steps:

providing two signal splitting circuits electrically connected to each other, the circuits together having two inputs and at least one output, each signal splitting circuit comprising at least two transmission lines, the signal splitting circuits splitting input signals within a frequency band between two transmission lines by virtue of a coupling effect between the lines, applying the signal comprising the low frequency component to one of the two inputs, applying the signal comprising the high frequency component, the high frequency component having a fundamental frequency within the frequency band, to the other of the two inputs, and outputting an output signal from said at least one output, the output signal comprising a combination of the signals comprising the low and high frequency components, the combination being effected by the coupling effect of each of the two signal splitting circuits.

29. A method according to claim 28, wherein the low frequency component includes or consists of a DC signal.

30. A method according to claim 28, wherein the high frequency component includes or consists of a signal having a fundamental frequency of greater than 500 MHz.

31. A method of combining two signals, the method comprising the steps of:

providing first and second couplers, the first coupler having a first transmission line directly connected to a first transmission line of the second coupler, the first coupler having a second transmission line directly connected to a second transmission line of the second coupler, the couplers each providing a coupling effect between the first and second transmission lines of the coupler, the coupling effect affecting only those signals having a frequency within a frequency range, applying a first low frequency DC signal below the frequency range to the first transmission line of the first coupler, applying a second high frequency RF signal within the frequency range to the second transmission line of the first coupler, and outputting an output signal comprising a combination of the first and second signals from the first transmission line of the second coupler, the output signal including signal components resulting from the constructive interference of signals split, as a result of the coupling effect, by the couplers.

32. A method of combining a DC signal and a high frequency RF signal, the method comprising the steps of:

providing two couplers each comprising at least two transmission lines, the couplers being directly electrically connected to each other, so that the signals passing from one coupler to the other coupler along the transmission lines are substantially unaffected, the couplers together having two inputs and at least one output, the couplers splitting input signals within a frequency band between two transmission lines by virtue of a coupling effect between the lines, applying a DC signal outside the frequency band to one of the two inputs, applying a high frequency RF signal having a fundamental frequency within the frequency band to the other of the two inputs, outputting an output signal from said at least one output, the output signal comprising a combination of the DC signal and the high frequency RF signal, the combination being effected by the coupling effect of each of the two couplers.

33. A method according to claim 32, the method including a step of splitting the high frequency RF signal into first and second signal components and imparting a relative phase shift such that said first and second signal components have a predetermined phase offset.

34. A method according to claim 33, wherein the method includes a further step of splitting each of said first and second signal components into at least two further signal components and imparting a further relative phase shift, such that said further signal components have a predetermined phase offset with respect to one another.

35. A method as claimed in claim 34, wherein said high frequency RF signal is substantially reproduced by constructive interference effects between said further signal components.

36. A method according to claim 32, wherein each transmission line of the two signal splitting circuits allows signals lower than the frequency band to pass substantially without attenuation.

* * * * *